United States Patent [19]

Kroll et al.

[11] Patent Number: 4,831,683

[45] Date of Patent: May 23, 1989

[54] VACUUM CLEANER

[75] Inventors: Clarence P. Kroll, Oceanside; Craig J. Neal, Orange; Robert L. Trapp, Dana Point, all of Calif.

[73] Assignee: Riccar America Company, Tustin, Calif.

[21] Appl. No.: 240,525

[22] Filed: Sep. 2, 1988

[51] Int. Cl.[4] ..... A47L 5/34

[52] U.S. Cl. ..... 15/361; 15/333

[58] Field of Search ..... 15/333, 361, 360, 410

[56] References Cited

U.S. PATENT DOCUMENTS

| | | | |
|---|---|---|---|
| 2,644,976 | 7/1953 | Osborn | 15/333 |
| 4,217,674 | 8/1980 | Hayashi et al. | 15/361 |
| 4,709,442 | 12/1987 | Sletten | 15/361 X |
| 4,782,552 | 11/1988 | Bartlett et al. | 15/333 |

FOREIGN PATENT DOCUMENTS

| | | | |
|---|---|---|---|
| 2835301 | 8/1979 | German Democratic Rep. | 15/333 |

*Primary Examiner*—Chris K. Moore

*Attorney, Agent, or Firm*—Lyon & Lyon

[57] ABSTRACT

There is disclosed herein an upright vacuum cleaner comprising a main body having a suction opening, and a handle body pivotally attached to the main body. A lifting assembly for the main body comprises a pair of wheel assemblies pivotally attached to the handle body. These wheel assemblies support the vacuum cleaner in a manner to raise its suction opening and brush assembly from the floor when the vacuum cleaner is in its full upright or idle condition. The wheel assemblies are suitably attached to receptacles in the handle body to allow these assemblies to move out of the way when the vacuum cleaner is used in the normal cleaning fashion, but to engage the floor when the handle body is moved to the full upright position.

5 Claims, 2 Drawing Sheets

VACUUM CLEANER

The present invention relates to vacuum cleaners, and more particularly to upright vacuum cleaners having a main body with a suction opening for picking up material from a floor surface and having a handle body pivoted to and extending from the main body.

BACKGROUND

Various forms of upright vacuum cleaners have been developed over the years. U.S. Pat. Nos. 4,217,674, 3,854,164, 3,676,892, and 3,416,181 show several forms of upright vacuum cleaners. Upright vacuum cleaners include a suction opening in the lower part of the main body, and the suction opening normally includes a rotatable brush and/or beater adjacent thereto. The cleaner has a handle or bag body which is pivotally mounted to the main body, and the former houses the dust bag into which dust and dirt are directed. Vacuum cleaners of this type sometimes are left running in an upright position wherein the suction opening and brush assembly remain in contact with a floor, rug or the like even though the cleaner is not moved back and forth for cleaning. This usually occurs when either (a) the vacuum cleaner is in an idle but running condition while the user is involved in some other activity, such as moving an article of furniture, or (b) when a vacuum hose and suction attachments are connected to the vacuum cleaner, as when cleaning a sofa or draperies. If the vacuum cleaner is allowed to remain running in this state for a prolonged period of time, the rotary brush assembly can damage the rug or floor. Also, the motor of the vacuum cleaner may become overheated because the floor will continually obstruct the suction opening in this case thereby reducing air entering the suction opening. The latter can result in damage to the main body housing, which usually is formed of plastic material, as well as the motor.

Various attempts have been made to obviate these problems, and have involved providing some mechanism for raising the suction opening from the rug or floor during such conditions of operation. U.S. Pat. No. 4,216,674 noted above particularly addresses this problem and also refers to U.S. Pat. Nos. 3,676,892 and 3,854,164. U.S. Pat. No. 4,216,674 describes a conventional prior construction in reference to FIG. 5 thereof which uses a pivoting lever, and points out the complex and unreliable construction thereof. The arrangement proposed in U.S. Pat. No. 4,216,674, while apparently different from prior constructions involves a design wherein the main body and handle body are provided with a cooperative pivoting arrangement to generate a "see-saw" type action to raise the suction opening from the floor or carpet when the handle body is in its upright position. An improved arrangement is disclosed in Bartlett et al. patent application Ser. No. 077,626, entitled Upright Vacuum Cleaner, filed July 24,1987.

SUMMARY

In accordance with the concepts of the present invention and a preferred embodiment thereof, an even simpler but sturdy lifting assembly is provided in the form of a pair of wheels mounted on a respective pair of arms. The arms are attached at or near the bottom of the handle body and can pivot with respect thereto. As the handle body is moved to the upright position, the arms and wheels lower and engage the floor surface to cause the suction opening to be lifted from the rug or floor in a very simple and efficient manner. When the handle body is lowered away from the upright position for normal vacuuming, the arms and wheels pivot and disengage from the floor and move out of the way.

Accordingly, it is an object of the present invention to provide an improved vacuum cleaner construction.

An additional object of this invention is to provide a relatively simple and sturdy wheel assembly for an upright vacuum cleaner and which causes the suction opening of the vacuum cleaner to be raised from the carpet or floor when the vacuum cleaner is in an upright idle condition.

BRIEF DESCRIPTION OF DRAWINGS

These and other objects and features of the present invention will become better understood through a consideration of the following description taken in conjunction with the drawings in which.

DETAILED DESCRIPTION

Figure 1:
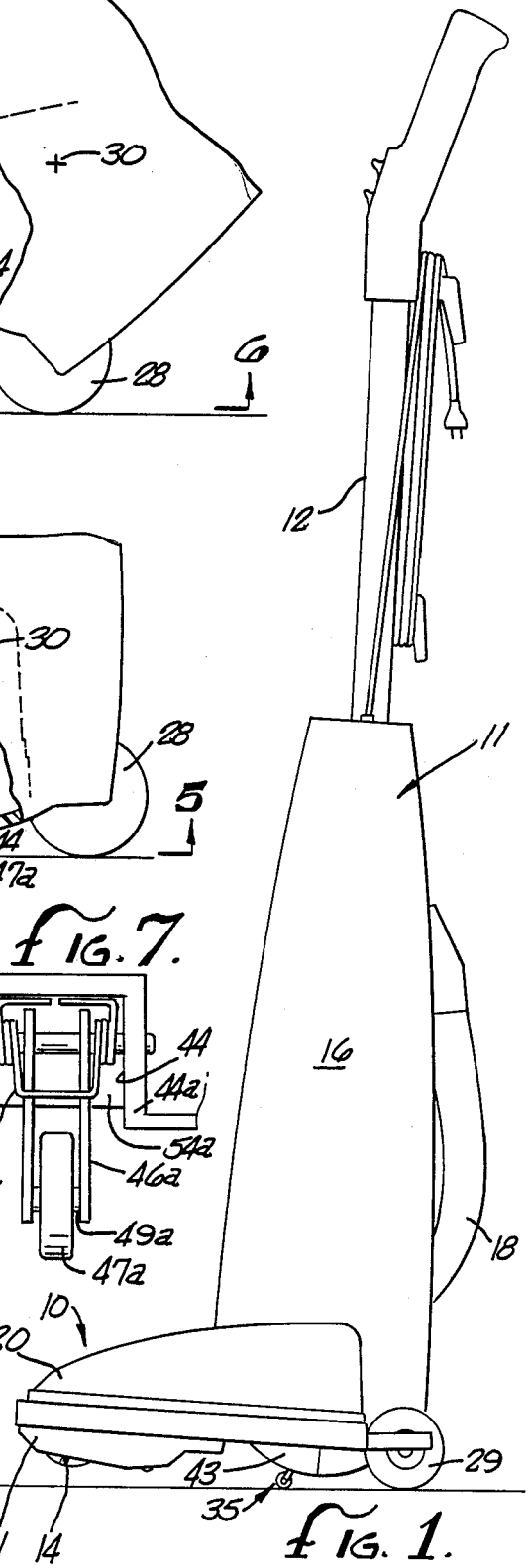
FIG. 1 is a side elevation view of an upright vacuum cleaner of the typical prior art type and which incorporates the concepts of the present invention.

Turning now to the drawings, and first to FIG. 1, an upright vacuum cleaner is illustrated having a main body 10 and a handle body 11 pivoted to the main body in a conventional manner. The handle body 11 has a handle 12 extending therefrom. The bottom of the handle body 11 houses a suitable motor (not shown) for driving a fan to provide the suction and for driving a typical brush assembly 14. The handle body 11 is in the form of an elongated box or container 16 and which includes a removable cover (not shown) and within which is arranged a conventional dust bag as is well known. A hose 18 conveys dust and dirt from the main body 10 to the dust bag contained in the handle body 11 in a conventional manner.

Figure 4:
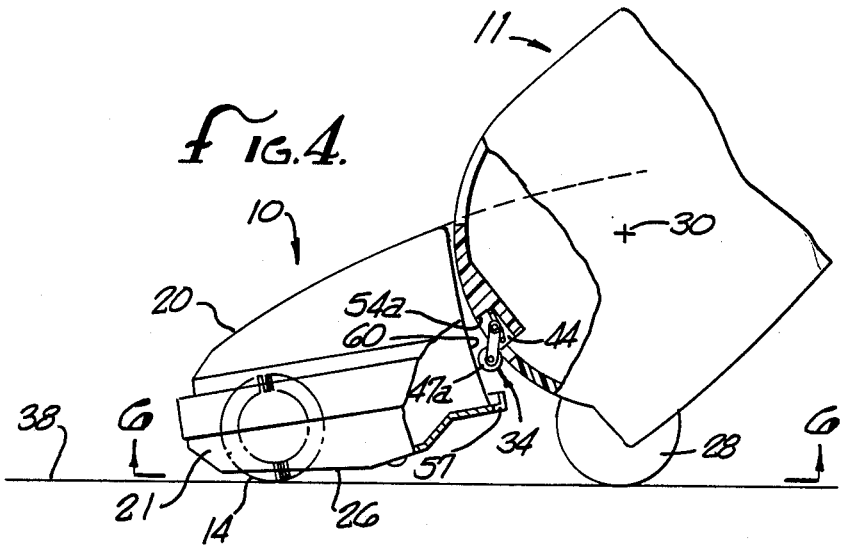
FIG. 4 is a partially broken away side view of the vacuum cleaner of FIG. 1 according to the present invention in normal operation for cleaning a floor surface and wherein the wheel assembly is retracted.

The main body 10 includes an upper housing 20 and a bottom cover 21 secured thereto in a conventional manner as by screw fasteners (not shown). The cover 21 has a usual suction opening 26, formed by openings **26*a* and 26*b* in the bottom of the cover 21, through which the brush assembly 14 extends and through which dust and dirt are drawn from the floor being vacuumed. The brush assembly 14 is rotatedly mounted in the body 10 and driven by the motor mentioned earlier, and the brush typically includes conventional brushes and beater bars. The handle body 11 is suitably pivotally mounted as in indicated at 30 to the main body 10. A pair of wheels 28 and 29 are mounted at the bottom of the handle body 11 also in a conventional manner to allow the vacuum cleaner to roll thereon as the same is moved back and forth in vacuuming as illustrated in FIG. 4**. The construction thus far described in this section is conventional, and is basically the same as that of upright vacuum cleaners sold, for example, in the United States by Riccar America Co, of Tustin, Calif., such as their Model 2000.

Figure 3:
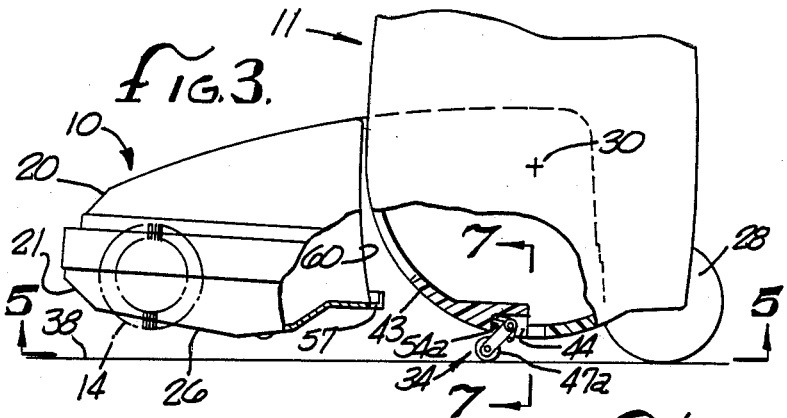
FIG. 3 is a partially broken away side view of the vacuum cleaner, taken along a line 3—3 of FIG. 2, and showing the handle body of the vacuum cleaner in an upright position with the wheel assembly of the present invention engaging the floor, and with the suction opening raised from the floor or carpet in an idle condition.

In accordance with the present invention, and a preferred embodiment thereof, the vacuum cleaner includes a lifting assembly comprising a pair of pivotally mounted wheel assemblies 34 and 35 which function to engage the floor 38 and raise the suction opening 26 off the carpet or floor 38 when the handle body 11 is raised to its upright vertical position as shown in FIGS. 1 and 3, but allows the suction opening 26 to engage the floor (rug or carpet) 38 when the handle body 11 is moved away from the upright vertical position of FIG. 3, such as to the position shown in FIG. 4, during normal operation of the vacuum cleaner.

The wheel assemblies 34 and 35 are mounted within respective receptacles 44 and 45 in the bottom 43 of the handle body 11. Each of the wheel assemblies 34 and 35 comprises an elongated arm 46 and a wheel 47. The wheels 47 are mounted via axles or pins 49 to the arms 46 at one end thereof, and the other end of each arm is pivotally mounted to the handle body receptacles 44-45 by pins 52. These latter ends include coil springs 53 to bias the wheel assemblies 34-35 to the position shown in FIG. 4. Thus, for example, the wheel assembly 34 comprises arm 46*a*, wheel 47*a*, pin 49*a*, pin 52*a*, and spring 53*a*. The receptacles 44-45 have forward faces 54*a* and 54*b* (note particularly FIGS. 3 and 4) which function as a stop as best seen in FIG. 3 to allow the wheel assemblies 34-35 to assume an angled position (as shown in FIG. 3) such that the main body 10, and particularly the suction opening 26 thereof, is raised off of the floor 38. The arms 46 engage the faces 54*a*-54*b* in this case. This provides the lifting action that keeps the brush assembly 14 from rotating against the floor, and leaves the suction opening 26 unobstructed, when the vacuum cleaner is moved to the upright position as shown in FIGS. 1 and 3.

Figure 7:
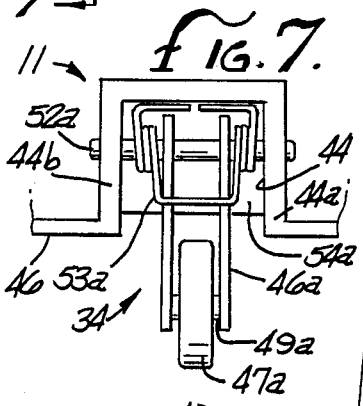
FIG. 7 is a further, more detailed view, of the manner in which one of the arm and wheel assemblies is attached to the handle body.
Figure 2:
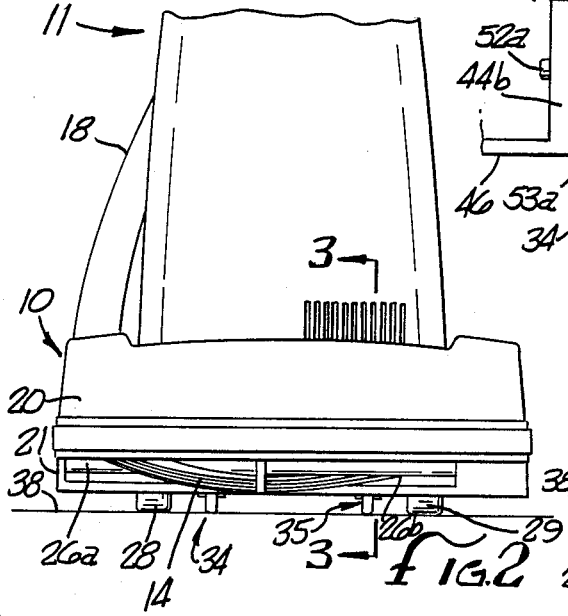
FIG. 2 is a front elevation view of the vacuum cleaner of FIG. 1.
Figure 5:
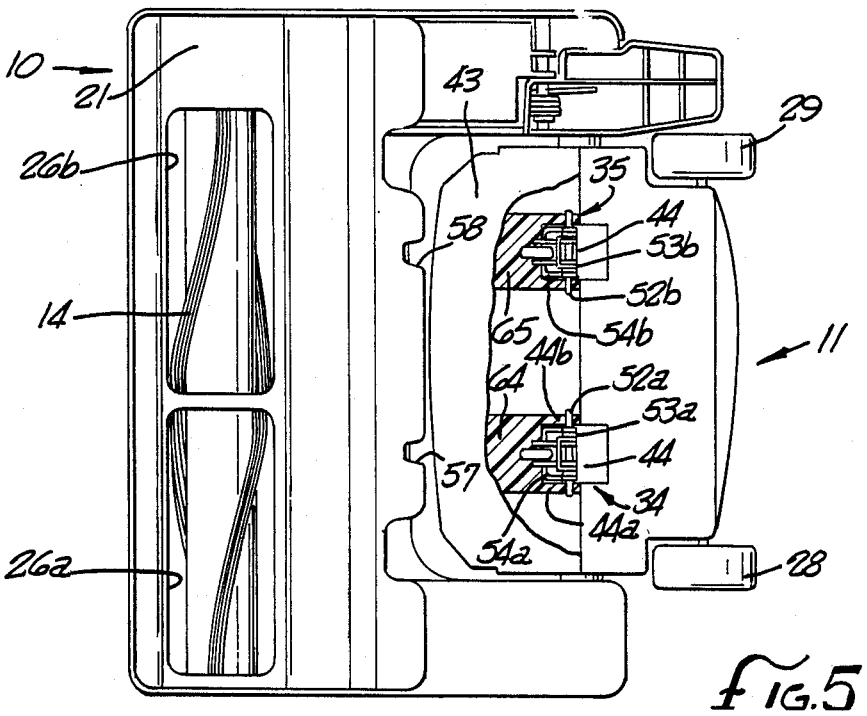
FIG. 5 is a bottom view of the vacuum cleaner wherein part of the bottom of the handle body is cut away to further illustrate mounting of the wheel assembly.
Figure 6:
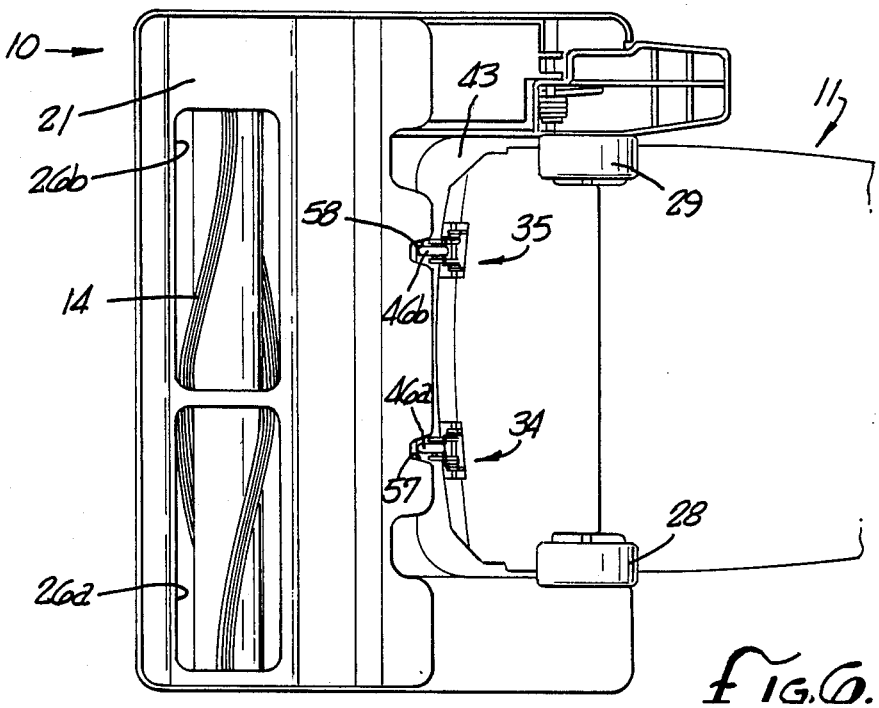
FIG. 6 is a bottom view of the vacuum cleaner.

When the handle body 11 is inclined rearwardly (rotated clockwise) for vacuuming as shown in FIG. 4, the wheels 47*a*-47*b* of the wheel assemblies 34-35 move upwardly off of the floor 38 and can retract by engaging a cam surface 60 on an inner portion of the main body 10. As the handle body 11 is again moved toward the upright vertical position as shown in FIGS. 1 and 3, the wheel assemblies 34 and 35 swing downwardly to again engage the floor 38 as shown in FIGS. 1 and 3 and, thus, raise the suction opening 26 and brush assembly 14 off the floor. As the vacuum cleaner is moved forward and/or the handle body 11 is again pivoted downwardly, the vacuum cleaner is again ready to resume the vacuuming operation as illustrated in FIG. 4. Slots 57 and 58 are formed in bottom plate 21 to provide spaces for the respective wheels 47*a* and 47*b* to pass as the handle body 11 is moved back and forth. The arms 46 preferably are spring biased as noted above to the position shown in FIG. 3 to thereby provide a more positive action. The receptacles 44-45 can be molded in the base 43 of the handle body 11 during manufacture of the body 11 which typically is molded from a suitable plastic material. Preferably these receptacles are molded in the body 11 to include enlarged bosses 64 and 65 (note FIG. 5) in the base section 43 to provide secure and strong stop faces 54. Each receptacle has a pair of sides (note sides 44*a* and 44*b* in FIG. 7) which receive and support the pivot pins 52.

Although a preferred embodiment of the present invention has been shown and described, it will be apparent to those skilled in the art that various modifications and variations can be made without departing from the inventive concepts disclosed herein, therefore, the invention is to be accorded the full scope of the appended claims.

What is claimed is:

1. An upright vacuum cleaner comprising a main body having a body housing and a cover, a suction opening provided in the cover of the main body through which dust and dirt can be picked up from a floor surface to be cleaned, a handle body pivotally mounted to the main body and being movable to various positions including an inclined position normally used during cleaning and an upright position, said handle body having a bottom section with supporting receptacle means formed therein, and lifting assembly means attached to said supporting receptacle means and pivotally mounted with respect thereto, the lifting assembly means having floor contacting means for engaging a floor surface for raising the suction opening from the floor surface when the handle body is moved to its upright position and being retractable out of contact with the floor surface when the handle body is moved to an inclined position with respect to the main body for normal vacuuming, said lifting assembly means comprising a pair of arms each having a first end pivotally attached to said supporting receptacle means and a second end each having a rotatably mounted wheel thereon.

2. A vacuum cleaner as in claim 1 wherein said supporting receptacle means comprises a pair of individual spaced receptacles molded in the bottom section of said handle body, said receptacles including openings for receiving pivot pin to which said first ends of said arms are attached, and spring means for biasing said arms toward a floor contacting position.

3. The vacuum cleaner as in claim 2 wherein said receptacles each include bosses providing stops for said arms of said lifting assembly means to maintain said arms in a predetermined inclined relationship with respect to the handle body when the handle body is moved to the upright position.

4. An upright vacuum cleaner comprising a main body having a body housing and a cover, a suction opening provided in the cover of the main body through which dust and dirt can be picked up from a floor surface to be cleaned, the cover including a pair of clearance slots, a handle body pivotally mounted to the main body and being movable to various positions including an inclined position normally used during cleaning and an upright idle position, said handle body having a bottom section with a pair of supporting receptacles formed therein, each of said receptacles including a boss providing a stop face and a pair of sides for receiving a pivot pin, and lifting assembly means attached to said supporting receptacle means and pivotally mounted with respect thereto, said lifting assembly means having floor contacting means for engaging a floor surface for raising the suction opening of the cover of the main body from a floor surface when the handle body is moved to an upright position and said lifting assembly means being retractable out of contact with a floor surface when the handle body is moved to an inclined position with respect to the main body for normal vacuuming, each said lifting assembly means comprising an elongated arm having a first end pivotally attached to said sides of said supporting receptacle by a pivot pin, and having a second end with a rotatably mounted wheel thereon, the wheels of said pair of arms comprising the floor contacting means, and spring means mounted between each of said arms and the supporting receptacles for normally biasing the arms and wheels toward a floor contacting position, and said clearance slots of said cover providing grooves by which said wheels can pass when said handle body is pivoted toward an inclined position.

5. A vacuum cleaner as in claim 4 wherein the bottom section of said handle body and said supporting receptacle means, including said bosses and sides, are all of a unitary construction molded from plastic material.

* * * * *